US005819665A

United States Patent [19]

McCormick

[11] Patent Number: 5,819,665

[45] Date of Patent: Oct. 13, 1998

[54] METHOD OF IMPRINTING A SINGLE-PLY IMPRINTABLE RECEIPT

[75] Inventor: Joseph A. McCormick, Manhattan, Ill.

[73] Assignee: General Credit Forms, Inc., Earth City, Mo.

[21] Appl. No.: 774,532

[22] Filed: Dec. 30, 1996

[51] Int. Cl.[6] ..... B41F 23/04

[52] U.S. Cl. ..... 101/483; 101/491; 101/492; 283/60.1; 283/60.2; 427/150; 428/332; 428/914; 462/25; 462/68

[58] Field of Search ..... 400/586; 101/483, 101/485, 491, 492; 283/60.1, 60.2, 72, 66.1; 462/2, 25–26, 68, 71, 23, 28; 427/150; 428/914, 488.4, 40, 43, 332

[56] References Cited

U.S. PATENT DOCUMENTS

| | | | |
|---|---|---|---|
| 3,981,523 | 9/1976 | Maalouf . | |
| 4,139,218 | 2/1979 | Davis et al. | 427/450 |
| 4,143,890 | 3/1979 | Davis et al. | 428/914 |
| 4,533,567 | 8/1985 | Marinelli | 427/150 |
| 4,614,363 | 9/1986 | Breen | 428/488.4 |
| 4,925,213 | 5/1990 | Anderson | 428/43 |
| 5,047,384 | 9/1991 | McCormick | 462/25 |
| 5,088,961 | 2/1992 | Sprain | 283/66.1 |
| 5,127,880 | 7/1992 | Bar et al. | 283/60.2 |
| 5,137,494 | 8/1992 | Schubert | 462/68 |
| 5,154,668 | 10/1992 | Schubert | 462/25 |
| 5,197,922 | 3/1993 | Schubert | 462/2 |
| 5,199,924 | 4/1993 | Fitzgibbons | 462/26 |
| 5,209,698 | 5/1993 | Dolan | 283/72 |
| 5,224,897 | 7/1993 | Linden et al. | 462/68 |
| 5,248,279 | 9/1993 | Linden | 462/71 |
| 5,346,430 | 9/1994 | Baxter | 462/2 |
| 5,393,265 | 2/1995 | Linden et al. | 462/25 |
| 5,395,288 | 3/1995 | Linden et al. | 462/28 |
| 5,478,279 | 12/1995 | McCormick | 462/25 |

*Primary Examiner*—Eugene H. Eickholt
*Attorney, Agent, or Firm*—Marshall, O'Toole, Gerstein, Murray & Borun

[57] ABSTRACT

An apparatus and method is provided for imprinting duplicate copies of a credit card receipt using a single-ply roll of paper. The paper can be either coated on a first side with a carbonless coating that contains rupturable microcapsules, each filled with reactive, colorless dyes, and coated on a second side with a resin adapted to react with the colorless dyes, or coated on a single side with self-contained microencapsulated colorless dyes and reactive resins. To include transaction information printed on the credit card receipt as well as information written on the receipt by the customer (such as a signature and an indication of the amount of any gratuity), the transaction information is substantially duplicated in two separate fields each on a separate portion of the credit card receipt. At least part of the two separate portions are then aligned and presented to the customer for completion. The two separate portions can be aligned by either folding the credit card receipt along a printed or imaginary line between the two separate portions, or by separating the two separate portions from one another and stacking the two separate portions one upon the other.

5 Claims, 1 Drawing Sheet

METHOD OF IMPRINTING A SINGLE-PLY IMPRINTABLE RECEIPT

BACKGROUND OF THE INVENTION

1. Field of the Invention

The invention is directed generally to a paper roll defining an imprintable form typically used to record retail sales transactions and a method for using the paper roll. More specifically, the invention is directed to a paper roll containing a single-ply, carbonless paper used for printing duplicate, sequential documents, such as credit card receipts.

2. Description of Related Technology

Carbonless papers are papers coated with carbonless image producing agents. The phrase "carbonless image producing agents," as used herein, includes any system of colorless agents that chemically react to form a color when placed in contact with another reactive agent.

Such carbonless image producing agents generally comprise a two-part system. One part of such a system includes chemically reactive, colorless dyes that are contained in rupturable microcapsules. The other part of such a system includes a coatable reactive resin which reacts on contact with the colorless dye to develop a visible color.

To produce an image with such a two-part system, a surface of a first paper is coated with the microencapsulated colorless dyes while a surface of a second paper is coated with the reactive resin. To produce an image, the coated surfaces of the first and second papers are brought together and pressure sufficient to rupture the microcapsules is applied. When the microcapsules rupture, the colorless dyes are released and react with the reactive resin to form an image on the surface of the resin coated paper. Thus, the image printed or written on the first paper is also imprinted on the second paper.

Another type of carbonless image producing agents comprises paper having at least one side coated with self-contained (SC) microencapsulated colorless dyes and reactive resins. SC coated paper can be used to create an image, for example, by printing on an uncoated or coated sheet that is stacked upon the SC coated paper. Alternatively, a first side of paper can be SC coated and a second side can be coated with microencapsulated colorless dyes or reactive resins that will react with the reactive resins or colorless dyes, respectively, of the SC coated side when placed in contact with the SC coated side of paper with sufficient pressure, to produce an image on the second side or the first side, respectively.

Image transfer processes using carbonless paper will be hereinafter referred to generally as "printing/imprinting."

Carbonless, multiple ply business forms generally include a number of plies that provide a desired number of copies of the form. For two-ply forms, the top ply is most often a coated back ("CB") paper and the adjacent underlying ply is a coated front ("CF") paper. In such a two-ply form, the CB paper is treated with a carbonless coating that contains rupturable microcapsules that are filled with reactive, colorless dyes. The CF paper is treated with a resin adapted to react with the colorless dyes. When the microcapsules are ruptured to allow contact of the colorless reactive dyes with the resin, a color changing reaction occurs that produces an image on the CF sheet of the underlying ply.

Multiple ply forms having three or more plies can also include a coated front and back ("CFB") ply. For example, in a three-ply form, the top ply may be a CB ply, the middle ply may be a CFB ply, and the bottom ply may be a CF ply.

The middle (CFB) ply is coated on both opposing surfaces such that the CF surface of the middle ply allows images to be made on the middle ply and the CB surface of the middle ply allows copies of such images to be made on the CF bottom ply.

Conventionally, the bottom surfaces of CB paper are coated with the microencapsulated colorless dyes, and the top surfaces of CF paper are coated with the reactive resin. In addition, CFB paper is coated on one surface with the reactive resin and on the opposing surface with the microencapsulated dyes.

Carbonless papers coated with such carbonless image producing agents that are suitable for use in the present invention are described in U.S. Pat. No. 3,981,523, for example, the disclosure of which is incorporated herein by reference. Other commercially available carbonless papers are sold under the trademark NCR PAPER®, by Appleton Paper Inc. of Appleton, Wis. Compatible carbonless papers are also produced by other manufacturers such as Moore Business Forms, 3M, Mead Paper and others.

One common continuous feed printing/imprinting system that produces variable sized and shaped forms or copies from a common feedstock is a "point of sale" printing/imprinting system. Such systems are commercially available from manufacturers such as VeriFone Inc., Hypercom, Inc. and Datacard Corp. Retail sales transactions using credit cards are typically recorded on continuously fed two-ply (or sometimes three-ply) carbonless paper rolls using standardized printing/imprinting equipment. As used herein, the term "credit cards" is understood to include credit cards, debit cards, or other similar means for transferring funds between parties. A two-ply carbonless paper roll having one ply stacked or layered on the other ply readily provides two copies of the sale. The top ply is printed by a printer and the printed image is imprinted on the bottom ply due to the carbonless coating or coatings.

Specifically, in a "point of sale" transaction, a customer's credit card having a magnetic information strip is passed through a magnetic reader. Information, such as the customer's name, account number, card expiration date, etc., is read from the magnetic strip and this information is then printed/imprinted onto a multiple-ply carbonless paper roll. At the same time, additional information related to the specific sale, such as merchant's name, items purchased, price, etc., is also printed/imprinted onto the paper roll. After all of the needed information is printed/imprinted and each ply of the paper roll contains a copy thereof, a sales clerk separates the printed/imprinted portion of the paper roll from the remainder of the paper roll. The separated, printed/imprinted portion of the roll, which varies in length from sale to sale, is presented to the customer for completion, for example, in a restaurant setting, by signing the printed/imprinted portion and indicating thereon the amount of any gratuity, then the two or more plies of the printed/imprinted portion are usually separated from one another by the sales clerk and separate copies containing complete copies of the printed/imprinted statement are retained by the sales clerk and the customer, respectively. Usually, the clerk keeps the printed top ply and the customer keeps the imprinted bottom ply.

More recently, "point of sale" printing systems have been developed that use a paper roll containing a single-ply of plain (uncoated) bond paper (having no imprintable second ply). Such single-ply "point of sale" systems are commercially available from manufacturers such as NCR, Micros Systems Inc. and Citizen. In order to generate separate copies of the printed statement, two or more copies of the transaction information are printed. Typically, two copies of the transaction information are printed sequentially on paper fed from a single-ply, uncoated bond paper roll.

If desired, additional copies of the transaction information may also be printed on one or more remote printers. For example, in a restaurant setting, a copy of the transaction information may be printed on a printer located in a kitchen, to facilitate the preparation of food and/or beverages ordered through the transaction.

In the above settings, such as in the restaurant setting, when the customer (i.e., the credit card holder) is to complete a printed statement, the customer typically signs the statement and also indicates the amount of any gratuity on the statement that is given to the clerk or to the waiter. However, when duplicates of the statement are printed sequentially, the customer typically keeps the unsigned copy, forgetting to record the amount of the gratuity, if any, that the customer had written on the statement given to the clerk or to the waiter. Such a sequence of events can lead to problems, as it can facilitate fraudulent indications of an inflated gratuity. Rightfully or mistakenly, the customer may dispute the total charged to the credit card account and reflected on a statement or bill from the credit card issuer, as reflecting a higher gratuity amount than that which was actually authorized by the customer. As a result, the restaurant is often faced with a "charge back" of the disputed amount and that amount must be credited to the credit card issuer account at least for an interim period until the matter is resolved. One restaurant chain alone has found this to be a problem costing the chain approximately one million dollars per year. As the single-ply receipt "point of sale" systems proliferate, such "charge backs" could potentially translate into hundreds of millions of dollars in lost revenues on an industry-wide basis.

SUMMARY OF THE INVENTION

It is an object of the invention to overcome one or more of the problems described above.

In accordance with one aspect of the invention, an imprintable receipt roll comprises a single ply of wound paper. The single ply of paper has at least one surface coated with a carbonless image producing agent.

The imprintable receipt roll may include a first surface of the single ply of paper that is coated with microencapsulated colorless dyes and a second opposing surface of the single ply of paper that is coated with a reactive resin adapted to react with the colorless dyes to produce an image.

Alternatively, the imprintable credit card receipt roll may include a first surface of the single ply of paper that is coated with self-contained microencapsulated colorless dyes and reactive resins.

A method for printing/imprinting a receipt, in accordance with another aspect of the present invention, comprises the steps of: providing a single-ply roll of paper having at least one surface coated with a carbonless image producing agent; printing a first field of information on a first surface of the paper on a first portion of the paper; printing a second field of information, substantially identical to the first field of information, on the first surface of the paper on a second portion of paper; separating the first and second portions of paper from the roll; aligning at least part of the first and second portions of paper; and presenting the first and second portions of paper to a customer for completion. The step of aligning at least part of the first and second portions may comprise a step of folding the first and second portions of paper along a line between the first and the second portions of paper. The step of aligning at least part of the first and second portions of paper may alternatively or additionally comprise a step of separating the first portion of paper from the second portion of paper and a step of stacking the first and second portions of paper one upon the other.

In accordance with yet another aspect of the invention, a method for printing/imprinting a receipt comprises the steps of: providing a single-ply roll of paper having at least one surface coated with a carbonless image producing agent; printing a first field of information on a first surface of the paper on a first portion of paper; printing a second field of information, substantially identical to the first field of information, on the first surface of the paper on a second portion of paper; separating the first and second portions of paper from the roll; folding the first and second portions of paper along a line between the first and the second portions of paper; and presenting the first and second portions of paper to a customer for completion. The method may further include a step of separating the first portion of paper from the second portion of paper after completion by the customer.

The invention disclosed and claimed herein serves to obviate the problems or disadvantages sometimes associated with the prior art while at the same time achieving the desired features for accurately recording transactions when a single-ply roll of paper is used to generate a receipt. This is accomplished by ensuring that both the merchant and the customer retain a contemporaneous record of information written on the receipt by the customer.

Other objects and advantages of the invention will be apparent to those skilled in the art from a review of the following detailed description taken in conjunction with the drawings and the appended claims.

DETAILED DESCRIPTION OF THE INVENTION

Figure 1:
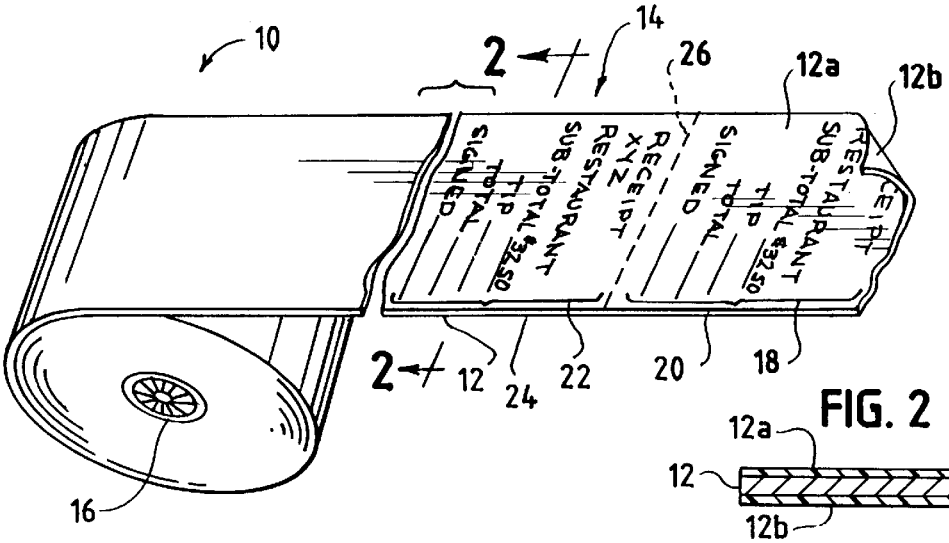
FIG. 1 is a perspective fragmentary view of an imprintable credit card receipt roll in accordance with the invention.

The invention provides a single-ply, carbonless paper roll suitable for use in "point of sale" printing equipment. As illustrated in FIG. 1, a single-ply carbonless paper roll, generally designated 10, includes a single carbonless paper ply 12 having respective upper and lower surfaces 12*a* and 12*b*. A typical roll 10 is approximately three inches wide with the outside diameter of a wound roll 10 being approximately 2½ to 3½ inches. The size of the roll 10 can vary depending upon a particular application. The carbonless paper ply 12 defines an imprintable credit card receipt form, generally designated 14. The carbonless paper ply 12 is wound about a core, illustratively a plastic or fiber spool 16. Transaction information is printed on the upper surface 12*a* in a first field of information 18 on a first portion 20 of the carbonless paper ply 12. Substantially the same transaction information is also printed in a second field of information 22 on a second portion 24 of the carbonless paper ply 12.

Figure 2:
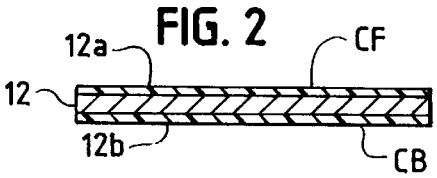
FIG. 2 is a cross sectional view, taken along lines 2—2 of FIG. 1, of a carbonless paper ply in accordance with a first embodiment of the present invention.

As illustrated in FIG. 2, in a first embodiment of the invention, the carbonless paper ply 12 is a CFB ply and the surfaces 12*a* and 12*b* are coated with carbonless chemical image producing agents, CF and CB, respectively. As noted above, typically, the CF coating is a reactive resin and the CB coating is a microencapsulated colorless dye. However, the CF coating can be an SC coating instead of simply a reactive resin.

Figure 3:
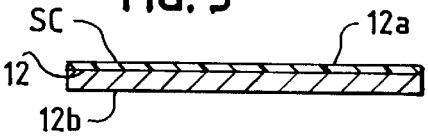
FIG. 3 is a cross sectional view, similar to that of FIG. 2, of a carbonless paper ply in accordance with a second embodiment of the invention.

As illustrated in FIG. 3, in a second embodiment of the invention, the carbonless paper ply 12 is coated on the upper surface 12*a* thereof with self-contained (SC) microencapsulated colorless dyes and reactive resins. The lower surface 12*b* is uncoated.

Figure 4:
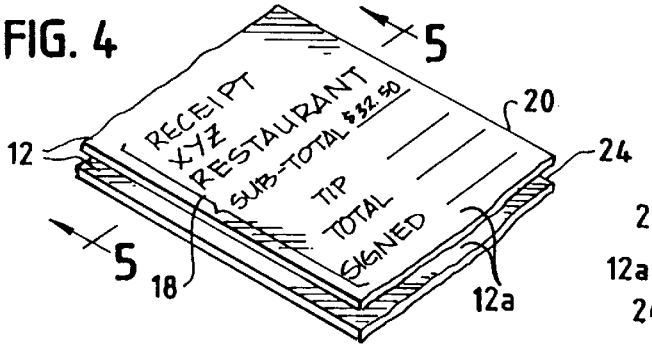
FIG. 4 is a perspective view of separated, stacked, and aligned first and second portions of a carbonless paper ply in accordance with the first or second embodiments of the invention.

FIG. 4 shows the carbonless paper ply 12 in accordance with the first or second embodiments wherein the first and second portions 20 and 24, respectively, have been separated from one another and the first portion 20 has been aligned with and stacked upon the second portion 24.

Figure 5:
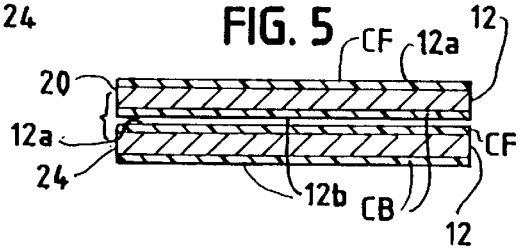
FIG. 5 is a cross-sectional view, taken along lines 5—5 of FIG. 4, of the carbonless paper ply in accordance the first embodiment of the invention.
Figure 6:
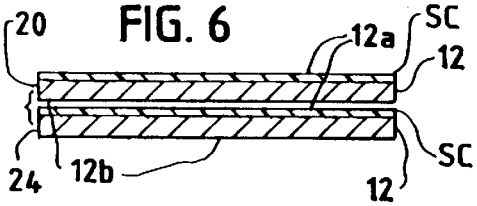
FIG. 6 is a cross sectional view, similar to that of FIG. 5, of the carbonless paper ply in accordance with the second embodiment of the invention.

FIG. 5 shows, in cross section, the carbonless paper ply 12 of FIG. 4 in accordance with the first embodiment. FIG. 6 shows, in cross section, the carbonless paper ply 12 of FIG. 4 in accordance with the second embodiment.

In both the first and second embodiments, the following procedure is used for completion of the credit card receipt form 14. After the transaction information has been printed on the upper surface 12*a*, the first and second portions 20 and 24, respectively, are separated from one another and the first portion 20 is aligned with and stacked upon the second portion 24, as seen in FIG. 4. (The separation of the first and second portions 20 and 24 may be accomplished, for example, by cutting the paper automatically, or by tearing the paper manually.) Then, the customer completes the credit card receipt form 14, for example, by indicating, on the first portion 20, the amount of, and total amount resulting from any gratuity, and by signing the credit card receipt form 14. The information written on the first portion 20 is transferred to the second portion 24, beneath the first portion 20, due to the carbonless image producing agents on the carbonless paper ply 12, namely, the CFB coatings in the first embodiment, or the SC coating in the second embodiment.

Although the first portion 20 is shown in FIG. 4 to be substantially completely aligned with the second portion 24, the present invention may be practiced even if only part of the first portion 20 is aligned with only part of the second portion 24, so long as there is sufficient overlap to ensure that information written on the first portion 20 will be imprinted on the second portion 24. Also, it should be noted that, instead of aligning and stacking the first portion 20 upon the second portion 24, the second portion 24 may be aligned with and stacked upon the first portion 20 without altering the result achieved by using the present invention.

Figure 7:
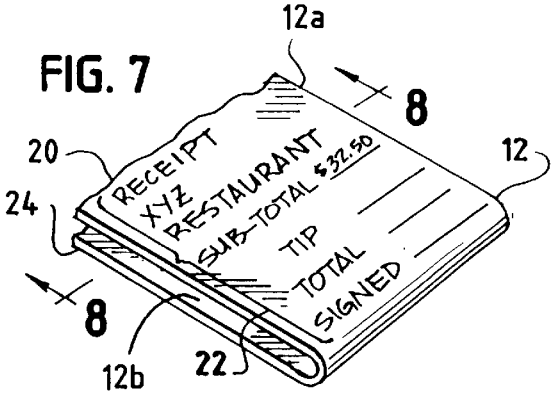
FIG. 7 is a perspective view of folded, stacked, and aligned first and second portions of a carbonless paper ply in accordance with a third embodiment of the invention.
Figure 8:
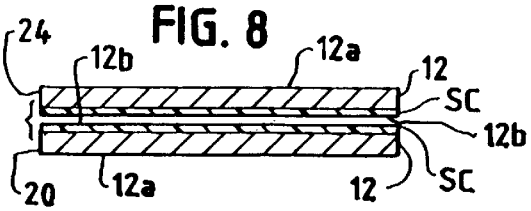
FIG. 8 is a cross-sectional view, taken along lines 8—8 of FIG. 7, of the carbonless paper ply in accordance the third embodiment of the invention.

FIG. 7 shows the carbonless paper ply 12 in accordance with a third embodiment of the invention in which the first portion 20 has been aligned with and stacked upon the second portion 24 by folding the credit card receipt form 14 along a dashed line 26 (FIG. 1), between the first and the second portions of paper 20, 24. The dashed line 26 may be printed on the carbonless paper ply 12, or alternatively it may be an imaginary line. As seen in cross section in FIG. 3, after the credit card receipt form 14 has been folded, the lower surface 12*b* of the first portion 20 is adjacent to and above the lower surface 12*b* of the second portion 24.

In the third embodiment, the following procedure is used for completion of the credit card receipt form 14. As seen in FIG. 7, after the transaction information has been printed on the upper surface 12*a*, the first portion 20 is aligned with and stacked upon the second portion 24 by folding the credit card receipt form 14 along a line between the first and second portions 20 and 24, such as, for example, the dashed line 26 (FIG. 1). Then, the customer completes the credit card receipt form 14, for example, by indicating, on the first portion 20, the amount of, and total amount resulting from any gratuity, and by signing the credit card receipt form 14. The information written on the first portion 20 is transferred to the lower surface 12*b* of the second portion 24, beneath the first portion 20, due to the carbonless image producing agents on the carbonless paper ply 12, namely, the SC coating disposed on the lower surface 12*b* of the carbonless paper ply 12.

Although the first portion 20 is shown in FIG. 7 to be substantially completely aligned with the second portion 24, the present invention may be practiced even if only part of the first portion 20 is aligned with only part of the second portion 24, so long as there is sufficient overlap to ensure that information written on the first portion 20 will be imprinted on the second portion 24. Also, it should be noted that, instead of aligning and stacking the first portion 20 upon the second portion 24, the second portion 24 may be aligned with and stacked upon the first portion 20 without altering the result achieved by using the present invention.

It is possible to practice the invention using an SC coating on the upper surface 12*a*, instead of on the lower surface 12*b*. However, this is not preferred, as such an arrangement may require the customer to press very hard on the paper ply 12 in order to ensure that a legible image is produced on the second portion 24.

The foregoing detailed description is given for clearness of understanding only, and no unnecessary limitation should be understood therefrom as modifications within the scope of the invention will be apparent to those skilled in the art.

What is claimed is:

1. A method for printing/imprinting a receipt, the method comprising the steps of:

providing a single-ply roll of paper having at least one surface coated with a carbonless image producing agent;

printing a first field of information on a first surface of the paper on a first portion of the paper;

printing a second field of information, substantially identical to the first field of information, on said first surface on a second portion of paper;

separating the first and second portions of paper from the roll;

aligning at least part of the first and second portions of paper; and presenting the first and second portions of paper to a customer for completion.

2. The method of claim 1, wherein the step of aligning at least part of the first and second portions comprises a step of folding the first and second portions of paper along a line between the first and the second portions of paper.

3. The method of claim 1, wherein the step of aligning at least part of the first and second portions comprises a step of separating the first portion of paper from the second portion of paper and a step of stacking the first and second portions of paper one upon the other.

4. A method for printing/imprinting a receipt, the method comprising the steps of:

providing a single-ply roll of paper having at least one surface coated with a carbonless image producing agent;

printing a first field of information on a first surface of the paper on a first portion of paper;

printing a second field of information, substantially identical to the first field of information, on the first surface of the paper on a second portion of paper;

separating the first and second portions of paper from the roll;

folding the first and second portions of paper along a line between the first and the second portions of paper; and presenting the first and second portions of paper to a customer for completion.

5. The method of claim 4, further including a step of separating the first portion of paper from the second portion of paper after completion by the customer.

* * * * *